US005517770A

United States Patent [19]

Martin et al.

[11] Patent Number: 5,517,770

[45] Date of Patent: May 21, 1996

[54] SHOE INSOLE

[75] Inventors: Jack L. Martin, Libertyville, Ill.; Charles Lee, Busan, Rep. of Korea

[73] Assignee: Libertyville Saddle Shop, Inc., Libertyville, Ill.

[21] Appl. No.: 216,715

[22] Filed: Mar. 23, 1994

[51] Int. Cl.[6] ..... A43B 13/38; A43B 23/00; A43B 13/18

[52] U.S. Cl. ..... 36/43; 36/28; 36/35 R; 36/37; 36/71

[58] Field of Search ..... 36/28, 35 R, 37, 36/43, 44, 71, 29

[56] References Cited

U.S. PATENT DOCUMENTS

| | | | |
|---|---|---|---|
| 1,540,430 | 6/1925 | Sims | 36/44 |
| 1,559,532 | 10/1925 | Smith | 36/28 |
| 1,741,419 | 12/1929 | Jones | 36/37 |
| 2,347,207 | 4/1944 | Margolin | 36/44 |
| 2,553,616 | 5/1951 | Walls | 36/29 |
| 2,928,193 | 3/1960 | Kristan | 36/44 |
| 4,255,877 | 3/1981 | Bowerman | 36/71 |
| 4,274,211 | 6/1981 | Funck | 36/29 |
| 5,092,060 | 3/1992 | Frachey et al. | 36/28 |
| 5,134,790 | 8/1992 | Woitschaetzke et al. | 36/28 |
| 5,201,125 | 4/1993 | Shorten | 36/28 |

FOREIGN PATENT DOCUMENTS

| | | | |
|---|---|---|---|
| 1302331 | 7/1962 | France | 36/28 |
| 9111928 | 8/1991 | WIPO | 36/28 |

*Primary Examiner*—Steven N. Meyers
*Assistant Examiner*—Marie Denise Patterson
*Attorney, Agent, or Firm*—Frank R. Thienpont

[57] ABSTRACT

An insole for a sport shoe including a foam footbed having disposed on the underside thereof a first resilient pad at the forward portion of the insole and a second resilient pad at the heel portion of the insole and including frusto-conical primary nubs formed integrally on each of the pads and a secondary nub formed on each of the primary nubs.

8 Claims, 1 Drawing Sheet

10
12

10
26

3
3
18
16
22
28
30
32
30
32
30

4
4
10
20
24
30
32
30
32

10

10
12
14
16
28
18
30
32
32
30
32
22

12
14
16
28
18
30
32
30
32

SHOE INSOLE

This invention relates to an insole for use in a sport shoe and is particularly adaptable for use in a riding shoe.

OBJECTS AND SUMMARY OF THE INVENTION

A principal object of the invention is to provide in a cushion insole system for use in a sport shoe an insole which has superior shock absorbing characteristics and substantial cushioning capabilities.

Another object of the invention is to provide a cushioning material which is of such construction that in use it will contribute to a foot massaging effect which is very desirable in shoes used in athletic activities.

A further object is to fashion an insole of such material and construction that will provide extra cushioning and shock absorption for the foot in a stirrup while riding.

Additional objects and features of the invention will become more apparent from the following description and accompanying drawings.

DESCRIPTION OF THE PREFERRED EMBODIMENT

Figures 1, 2, 2A, 2B, 3, 4:
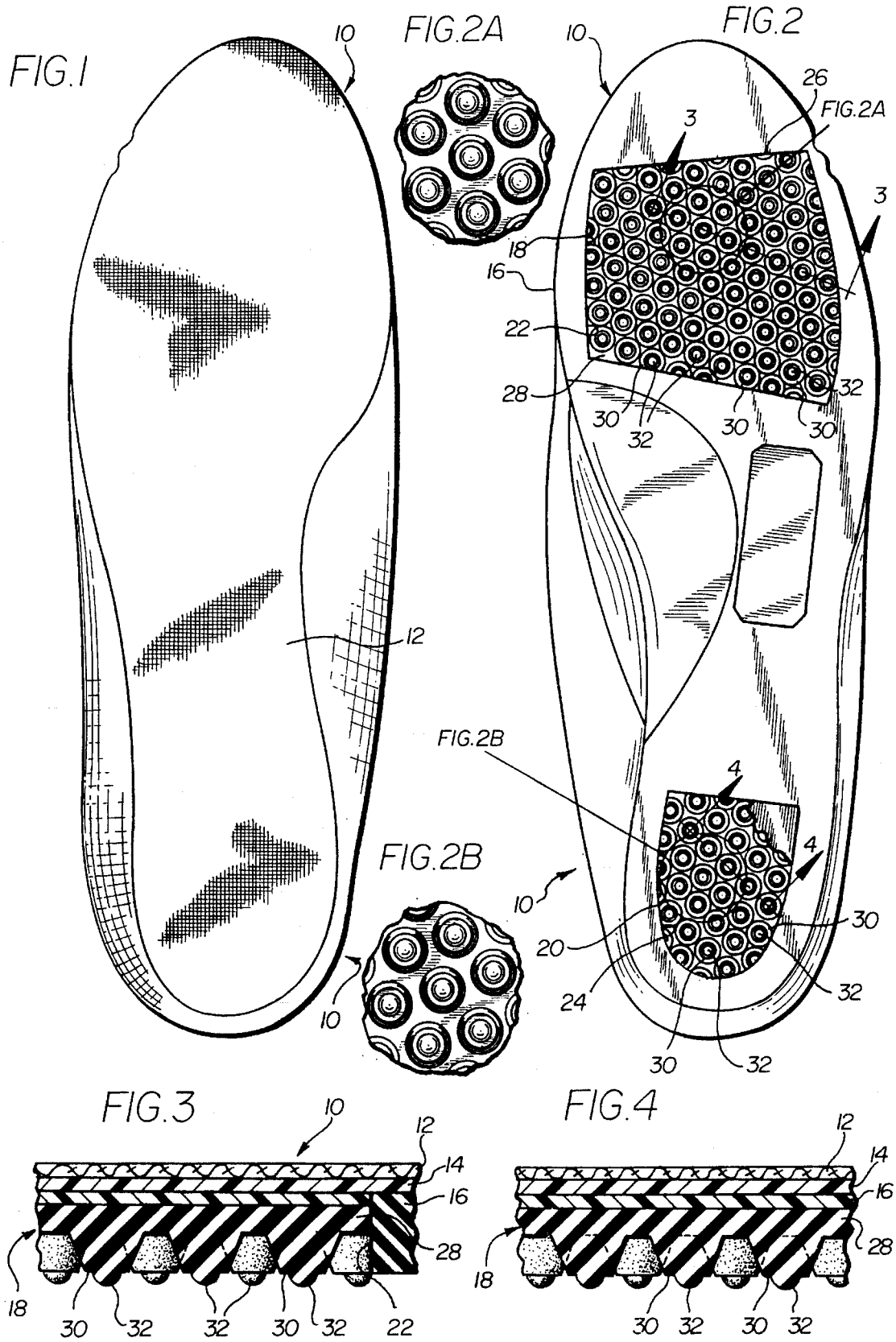
FIG. 1 is a top plan view of an insole embodying the invention herein.
FIG. 2 is a bottom plan view of the insole of FIG. 1.
FIGS. 2A and 2B are enlarged portions of corresponding circled areas of pads 18 and 20.
FIG. 3 is a partial enlarged sectional view in elevation taken along line 3—3 of FIG. 2.
FIG. 4 is a partial enlarged sectional view in elevation taken along line 4—4 of FIG. 2.

Referring now to the drawings wherein like reference characters refer to like parts, FIGS. 1 and 2 show a flexible insole 10. The insole 10 includes a layer 12 of moisture wicking material which is permanently bonded to a foam backing 14. The backing 14 in turn is bonded to a high density EVA foam footbed 16. Resilient pad means are secured to the underside of the foam footbed 16 and includes first and second resilient pads 18 and 20. The moisture wicking material helps to soak up perspiration. The resilient pad means provide additional cushioning and shock absorption at those portions of a foot which rests on this pad means.

The first resilient pad 18 is secured to the underside of the foam footbed 16 at the forward end or the forefoot of the insole 10. The second resilient pad 20 is secured to the underside of the foam footbed 16 at the heel end of the insole 10. While the pads 18 and 20 could be secured to a footbed having a flat surface, preferably they are disposed respectively in cavities 22 and 24 formed in the bottom surface of footbed 16. These cavities or foundation pockets, as they are sometimes referred to, assist in holding the pads 18 and 20 in place in their predetermined positions in association with the foam footbed 16. The pads 18 and 20 are adhesively secured in the cavities 22 and 24.

It will be observed from FIG. 2 that the forward portion of pad 18 is truncated and that the forward edge 26 of pad 18 does not extend all the way to the forward edge of the toe portion of the insole footbed 16, i.e., it does not extend over the portion of the insole where the toes would normally rest.

The resilient pads preferably are made of a relatively stiff elastomeric compressible rubberlike or gel material such, for example, as a PVC material. These pads function as a cushioning and shock absorbing material capable of withstanding substantial repeated shocks to the foot, such, for example, as stirrup shocks experienced by a rider when engaged in horseback jumping activities or other riding activities.

The resilient pads 18 and 20 each include a sheet-like base portion 28 and a plurality of frusto-conical shaped primary nubs 30 formed integrally with the sheet-like base portion 28. A small substantially hemi-spherically shaped secondary nub 32 is formed integrally with, and depends from, each primary nub. The secondary nub is disposed coaxially with the primary nub. It will be noted that the secondary nubs are of a smaller diameter than the lower surface of the frusta to which they are attached.

Although these resilient pads may be made with different size nubs we have found that a construction with the following approximate dimensions yields a product which is highly satisfactory.

The resilient pads are constructed with approximately four primary nubs per linear inch. Each of the primary nubs 30 is approximately 3/16" in diameter at its base, i.e., where it intersects with the base portion 28. The overall height of the primary and secondary nubs together may be approximately 1/8".

Because of a certain lateral flexibility of the primary nubs, which is assisted by the direct almost pinpoint-like contact of the smaller secondary nubs with the foot, a beneficial secondary effect, namely a massaging effect on the foot occurs.

While a preferred embodiment of the invention has been disclosed, it will be appreciated that this is shown by way of example only, and the invention is not to be limited thereto as other variations will be apparent to those skilled in the art, and the invention is to be given its fullest interpretation within the terms of the following claims.

What is claimed is:

1. In a cushion insole system for a shoe the combination comprising:

an elongated flexible insole having a top and bottom surface;

elastomeric resilient pad means for providing a cushioning effect attached to the bottom surface of said sole;

a plurality of frusto-conical shaped primary nubs formed integrally on and disposed over substantially the entire exposed surface of said resilient pad means; and small substantially hemispherically shaped secondary nubs formed integrally with and depending from the bottom of each of said frusto-conical shaped primary nubs.

2. The combination of claim 1 wherein said elastomeric resilient pad means comprises:

a first pad disposed at the forward part of the insole so as to be positioned under the ball of the foot when in use, and a second pad disposed at the heel portion of the sole.

3. The combination of claim 2 including means defining first and second cavities for containing pad means formed in the bottom surface of said flexible insole, the first at the forward part of said insole and the second at the heel portion of said insole, said first and second elastomeric pads being disposed in said first and second cavities, respectively.

4. The combination of claim 3 including adhesive means securing said first and second elastomeric pads in said first and second cavities.

5. The combination of claim 2 wherein said first resilient pad disposed at the forward part of the sole is truncated at its forward end so that when in use in a shoe the toes of a wearer generally will not make any substantial contact with said pad.

6. The combination of claim 1 wherein said resilient pad means is made of a PVC material.

7. The combination of claim 1 wherein said frusto-conical shaped primary hubs cover substantially the entire exposed surface of said resilient pad means and are arranged closely adjacent each other in a plurality of linear patterns in which the primary nubs number approximately four primary nubs per inch.

8. The combination of claim 1 wherein the overall depth of each of said primary nubs and their respective associated secondary nubs is approximately ⅛ of an inch.

* * * * *